US010119439B2

(12) United States Patent
Kashiwabara et al.

(10) Patent No.: US 10,119,439 B2
(45) Date of Patent: Nov. 6, 2018

(54) BLOW-BY GAS RECIRCULATING APPARATUS

(71) Applicant: MAZDA MOTOR CORPORATION, Hiroshima (JP)

(72) Inventors: Takashi Kashiwabara, Hiroshima (JP); Kouichi Shimizu, Higashihiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 15/332,015

(22) Filed: Oct. 24, 2016

(65) Prior Publication Data

US 2017/0152777 A1 Jun. 1, 2017

(30) Foreign Application Priority Data

Dec. 1, 2015 (JP) ..... 2015-235081

(51) Int. Cl.

| | |
|---|---|
| ***F01M 13/04*** | (2006.01) |
| ***F01M 13/00*** | (2006.01) |
| ***F02D 41/00*** | (2006.01) |
| ***F02M 25/06*** | (2016.01) |
| ***F02M 35/10*** | (2006.01) |
| ***F02M 35/104*** | (2006.01) |

(52) U.S. Cl.

CPC ..... *F01M 13/04* (2013.01); *F01M 13/0011* (2013.01); *F02D 41/0025* (2013.01); *F02M 25/06* (2013.01); *F02M 35/104* (2013.01); *F02M 35/10222* (2013.01); *F02D 2250/08* (2013.01)

(58) Field of Classification Search

CPC .... F01M 13/04; F01M 13/0011; F02M 25/06; F02M 35/10222; F02M 35/104; F02D 41/0025

See application file for complete search history.

(56) References Cited

U.S. PATENT DOCUMENTS

| | | | | |
|---|---|---|---|---|
| 6,009,863 | A * | 1/2000 | Tochizawa | F01M 13/022 123/184.47 |
| 2002/0073961 | A1 * | 6/2002 | Tanaka | F02D 9/101 123/336 |
| 2004/0244783 | A1 | 12/2004 | Ookawa et al. | |
| 2014/0096753 | A1 | 4/2014 | Monros | |

(Continued)

FOREIGN PATENT DOCUMENTS

| | | |
|---|---|---|
| CN | 104822913 A | 8/2015 |
| JP | H07-054629 A | 2/1995 |

(Continued)

*Primary Examiner* — Jacob Amick
*Assistant Examiner* — Charles Brauch
(74) *Attorney, Agent, or Firm* — Studebaker & Brackett PC

(57) ABSTRACT

A blow-by gas recirculating apparatus includes: an oil separator provided to a side surface of a cylinder block at one side of an engine; a communication part providing communication between a blow-by gas outlet port of the oil separator and an intake manifold; and a PCV valve. The PCV valve is provided to the intake manifold, and the communication part is connected to the PCV valve. The PCV valve provided to the intake manifold is positioned above the blow-by gas outlet port of the oil separator with the engine mounted on a vehicle.

14 Claims, 4 Drawing Sheets

(56) References Cited

U.S. PATENT DOCUMENTS

| | | | | |
|---|---|---|---|---|
| 2014/0096754 | A1* | 4/2014 | Monros | F01M 13/0011 123/574 |
| 2014/0109873 | A1* | 4/2014 | Allezy | F02D 41/403 123/435 |
| 2015/0159596 | A1* | 6/2015 | Wakiya | F01M 13/00 123/41.86 |
| 2015/0345349 | A1 | 12/2015 | Monros | |

FOREIGN PATENT DOCUMENTS

| | | | | |
|---|---|---|---|---|
| JP | 2004-308539 | A | | 11/2004 |
| JP | 2009-185664 | A | | 8/2009 |
| JP | 2009-264275 | A | | 11/2009 |
| JP | 2010084742 | A | * | 4/2010 |
| JP | 2010084742 | A | * | 4/2010 |

* cited by examiner

BLOW-BY GAS RECIRCULATING APPARATUS

CROSS-REFERENCE TO RELATED APPLICATION

This application claims priority to Japanese Patent Application No. 2015-235081 filed on Dec. 1, 2015, the entire disclosure of which is incorporated by reference herein.

BACKGROUND

The present disclosure relates to a blow-by gas recirculating apparatus.

In an automotive engine, blow-by gas enters a crankcase from a combustion chamber. An oil separator separates oil mist from the blow-by gas, and then the blow-by gas is returned to the engine intake system for re-combustion.

Japanese Unexamined Patent Publication No. 2009-264275 discloses, for example, an oil separator provided to a side face of an engine cylinder block, and a positive crankcase ventilation (PCV) valve directly provided to an oil separator cover of the oil separator. Here, the PCV valve adjusts the amount of recirculating blow-by gas.

SUMMARY

When a geometrical compression ratio of an engine is increased to improve, for example, engine thermal efficiency, a combustion pressure rises. The rise of the combustion pressure increases the amount of blow-by gas entering a crankcase from a combustion chamber. Here, it is beneficial to increase the amount of the recirculating blow-by gas. In order to achieve this, however, the oil separator has to have high gas-liquid separation capability.

In seeking to enhance the gas-liquid separation capability of the oil separator, possible techniques include providing more baffle plates in the oil separator, and increasing the volume of the gas-liquid separation space in the oil separator. However, the former technique increases flow resistance of the blow-by gas, resulting in a decrease in flow amount of the blow-by gas. This technique has difficulty in increasing the amount of recirculating blow-by gas. Meanwhile, the latter technique has a difficulty in leaving enough space to increase a volume of the oil separator in a narrow engine compartment.

The present disclosure is conceived in view of the above problems, and enhances gas-liquid separation capability without increasing a size of an oil separator.

A blow-by gas recirculating apparatus in this disclosure includes: an intake manifold secured to one side of an engine, and configured to introduce intake air into a combustion chamber; an oil separator provided to a side surface of a cylinder block at the one side of the engine, and configured to separate oil mist from the blow-by gas; a communication part configured to provide communication between a blow-by gas outlet port of the oil separator and the intake manifold; and a PCV valve configured to adjust a flow amount of the blow-by gas to be introduced into the intake manifold via the communication part.

The PCV valve is provided to the intake manifold. The communication part is connected to the PCV valve. The PCV valve provided to the intake manifold is positioned above the blow-by gas outlet port of the oil separator with the engine mounted on a vehicle.

In the above configuration, the PCV valve of the blow-by gas recirculating apparatus is provided to the intake manifold. In a configuration disclosed in Japanese Unexamined Patent Publication No. 2009-264275 described before, the PCV valve occupies a space when provided to the separator cover of the oil separator. The configuration of the present disclosure makes it possible to use the space as a gas-liquid separation space of the oil separator. Specifically, in this configuration, the oil separator of the present disclosure is larger in volume of the gas-liquid separation space than the oil separator disclosed in the patent publication for the space in which the PCV valve is provided, even if the separators are the same in size. Such a feature may enhance the gas-liquid separation capability of the oil separator.

Moreover, the PCV valve provided to the intake manifold is positioned above the blow-by gas outlet port of the oil separator. While the blow-by gas is flowing through the communication part providing communication between the oil separator and the intake manifold, oil mist is separated from the blow-by gas. The resulting oil mist returns toward the oil separator positioned relatively low. The communication part includes a space acting as the gas-liquid separation space, substantially increasing the volume of the gas-liquid separation space in the oil separator. Such a feature further enhances the gas-liquid separation capability of the oil separator.

As a result, even if the engine has a high compression ratio and more blow-by gas enters the crankcase, the amount of recirculating blow-by gas may be increased, contributing to reducing deterioration of the oil.

The PCV valve may be provided to a surge tank of the intake manifold, and introduce the blow-by gas into an upstream portion of an airflow in the surge tank.

Such a configuration allows the blow-by gas returned to the intake system to be sufficiently mixed with intake air in the surge tank. The sufficient mixing contributes to uniformity in concentration of the blow-by gas, downstream from the surge tank, to be introduced into the cylinders through independent passageways each provided for a corresponding one of the cylinders.

The PCV valve may be electronically controlled, and have an opening adjusted with a control signal.

Providing the PCV valve to the intake manifold improves responsiveness, in the introduction of the blow-by gas into the intake manifold, to a change in the opening of the PCV valve. Furthermore, the PCV valve provided to the intake manifold is electronically controlled, improving the responsiveness, in the introduction of the blow-by gas into the intake manifold, to the control signal for adjusting the opening of the PCV valve. Such features are beneficial in controlling an air-fuel ratio of the engine with high responsiveness, improving accuracy in the air-fuel ratio control.

Based on an estimate of a fuel component concentration in the blow-by gas, the PCV valve, electronically controlled, may set the opening greater as the estimate of the fuel component concentration is higher.

Such a configuration may increase a volume of ventilation air in the crankcase when the crankcase needs ventilation.

The PCV valve may be placed between the engine and the intake manifold secured to a side portion of the engine.

When the vehicle collides, such a configuration allows the impact load to be applied to the intake manifold before applied to the PCV valve. The intake manifold made of, for example, resin may absorb the impact load, contributing to reducing a risk of damaging the PCV valve.

DETAILED DESCRIPTION

Figure 1:
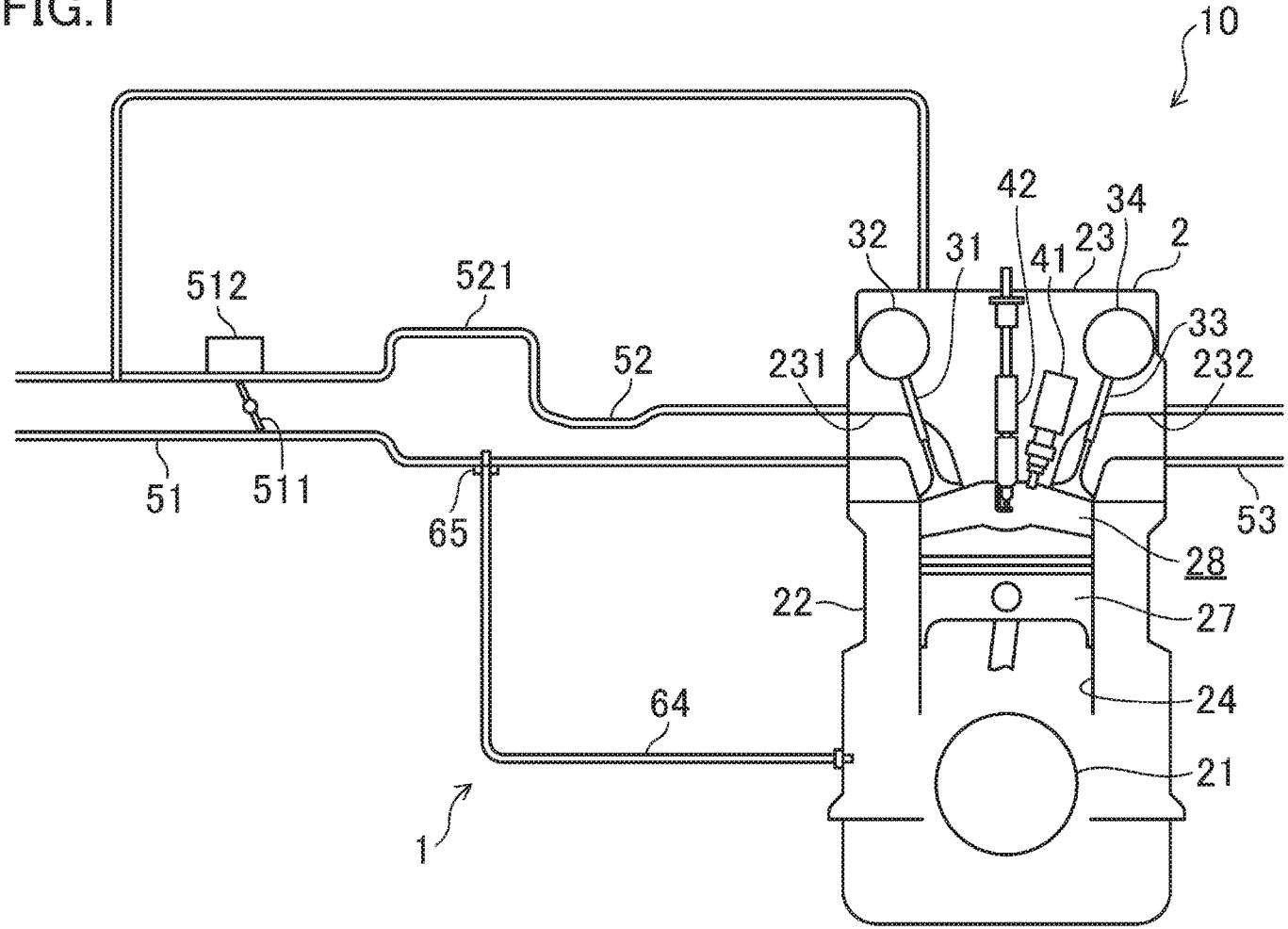
FIG. 1 is a conceptual diagram illustrating a configuration of an engine system including a blow-by gas recirculating apparatus.

Described below in detail is a blow-by gas recirculating apparatus of the present disclosure, with reference to the drawings. Note that the description below is an example. FIG. 1 illustrates a configuration of an engine system 10 including a blow-by gas recirculating apparatus 1.

The engine system 10 includes an engine 2 which is a spark-ignited internal combustion engine. The engine 2 is so-called transversely mounted; that is, a crankshaft of the engine 2 extends along the width of a vehicle, such as a car, in an engine compartment provided in the front of the car. Details of the arrangement are not shown. The engine 2 has an output shaft; namely a crankshaft 21, coupled to a drive wheel via a not-shown transmission. The vehicle runs when the power of the engine 2 is transmitted to the drive wheel.

Figure 2:
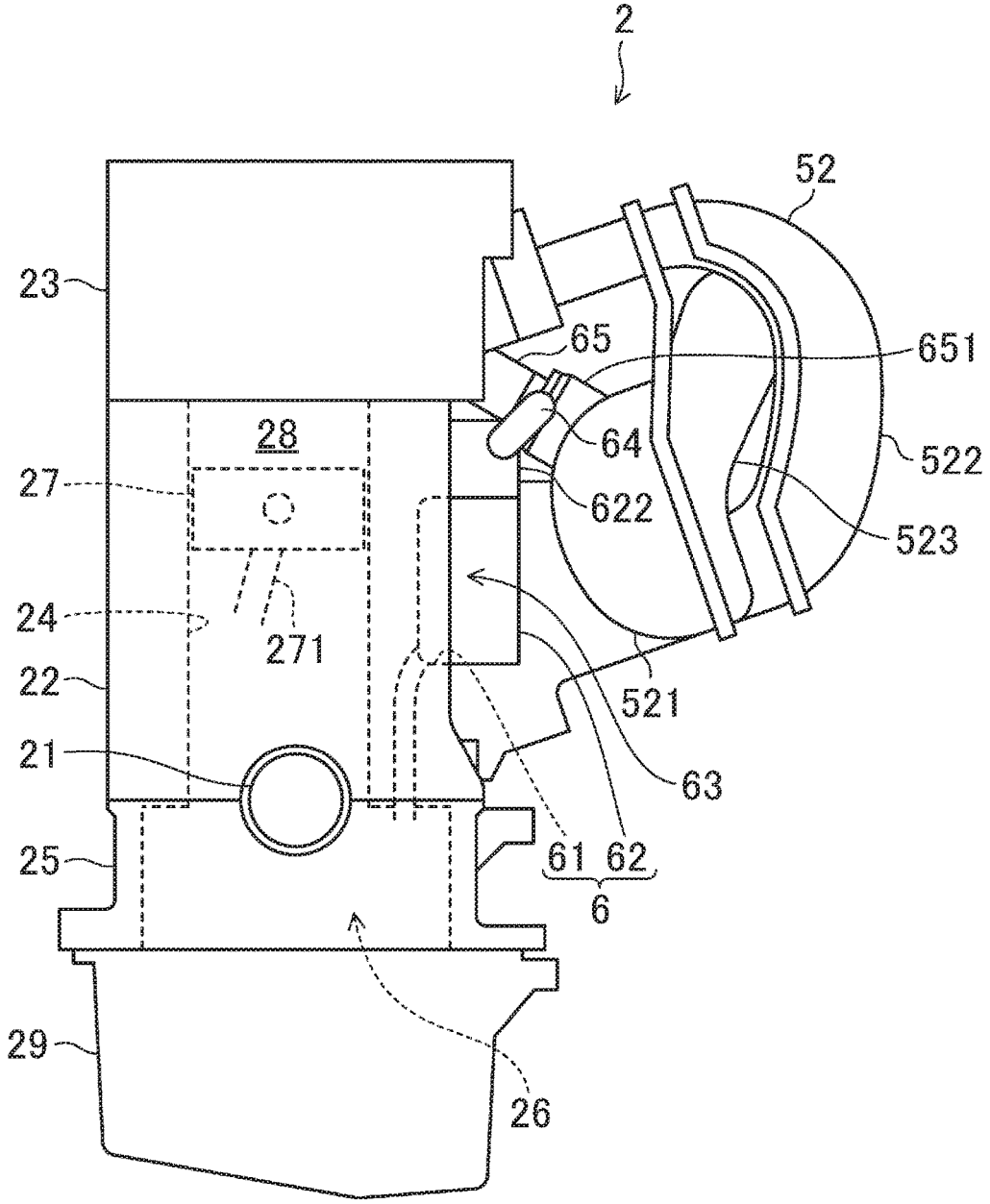
FIG. 2 is a front view illustrating an engine equipped with the blow-by gas recirculating apparatus.

As illustrated in FIG. 2, too, the engine 2 includes a cylinder block 22, and a cylinder head 23 placed on the cylinder block 22. Multiple cylinders 24 are provided in the cylinder block 22. In this example, the engine 2 has four cylinders 24. The four cylinders 24 are aligned in a direction perpendicular to the view in FIG. 2.

A lower block 25 is placed below the cylinder block 22. An oil pan 29, storing lubricant oil, is secured below the lower block 25. The crankshaft 21 is rotatably supported between the cylinder block 22 and the lower block 25. The cylinder block 22 and the lower block 25 define a crankcase 26 containing the crankshaft 21.

The crankshaft 21 is connected to a piston 27 via a connecting rod 271 part of which is not shown. The piston 27 is reciprocably inserted into each cylinder 24. The piston 27, the cylinder head 23, and the cylinder 24 define a combustion chamber 28.

Here, this engine 2 has a high geometrical compression ratio ε (e.g. $\varepsilon \geq 15$) in order to enhance thermal efficiency.

As illustrated in FIG. 1, the cylinder head 23 has an intake port 231 for each cylinder 24. The intake port 231 communicates with the combustion chamber 28. The intake port 231 is provided with an intake valve 31 which may block the combustion chamber 28 from the intake port 231. The intake valve 31 is driven by an intake valve train 32. The intake valve 31 opens and closes the intake port 231 with predetermined timing.

The cylinder head 23 also has an exhaust port 232 for each cylinder 24. The exhaust port 232 communicates with the combustion chamber 28. The exhaust port 232 is provided with an exhaust valve 33 which may block the combustion chamber 28 from the exhaust port 232. The exhaust valve 33 is driven by an exhaust valve train 34. The exhaust valve 33 opens and closes the exhaust port 232 with predetermined timing.

The intake valve train 32 includes a not-shown intake camshaft, and the exhaust valve train 34 includes a not-shown exhaust camshaft. Although not shown, these camshafts are connected to, and driven by, the crankshaft 21 via a known power transmission mechanism. The intake camshaft and the exhaust camshaft rotate in conjunction with the rotation of the crankshaft 21.

The intake valve train 32 may vary a lift amount and an opening period of the intake valve 31. The intake valve train 32 may be any known intake valve train. The intake valve train 32 may include a variable valve motion mechanism which, for example, hydraulically varies the lift amount and the opening period of the intake valve 31.

The exhaust valve train 34 may also vary a lift amount and an opening period of the exhaust valve 33. The exhaust valve train 34 may be any known exhaust valve train. The exhaust valve train 34 may continuously vary the lift amount and the opening period of the exhaust valve 33, using, for example, hydraulic pressure increased by the camshaft.

An intake passageway 51 is connected to the intake port 231. The intake passageway 51 introduces intake air into the cylinder 24. The intake passageway 51 has a throttle valve 511 inserted therein. The throttle valve 511 is electronically controlled. A throttle actuator 512 adjusts an opening of the throttle valve 511, upon receiving a control signal output from a not-shown engine controller. Through adjustments of the opening of the throttle valve 511 and the lift amount and/or the opening period of the intake valve 31, the amount of the intake air to be introduced into the cylinder 24 is adjusted.

Figure 3:
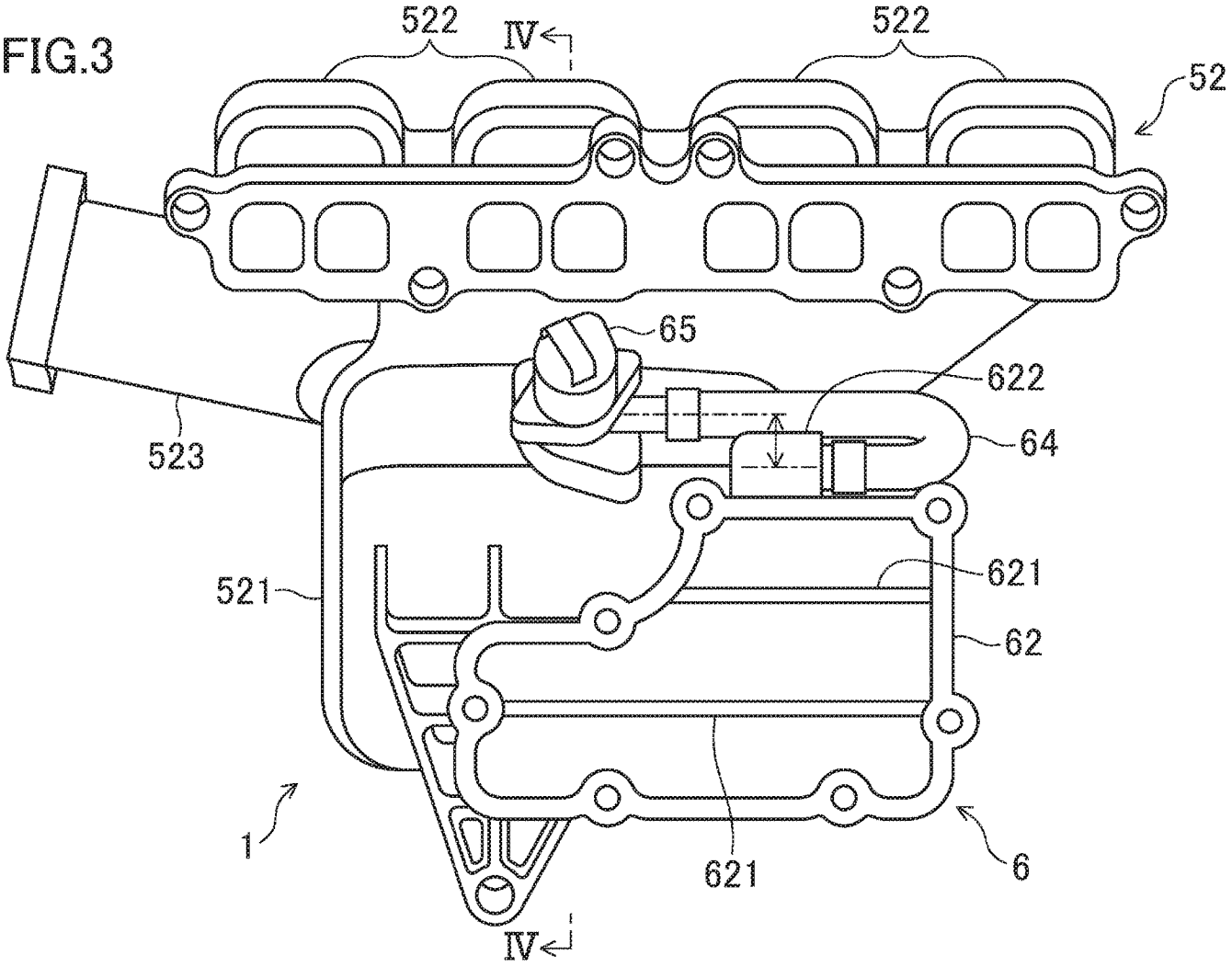
FIG. 3 is a diagram illustrating an intake manifold provided with a PCV valve, and an oil separator cover communicating with the intake manifold via a communication part.
Figure 4:
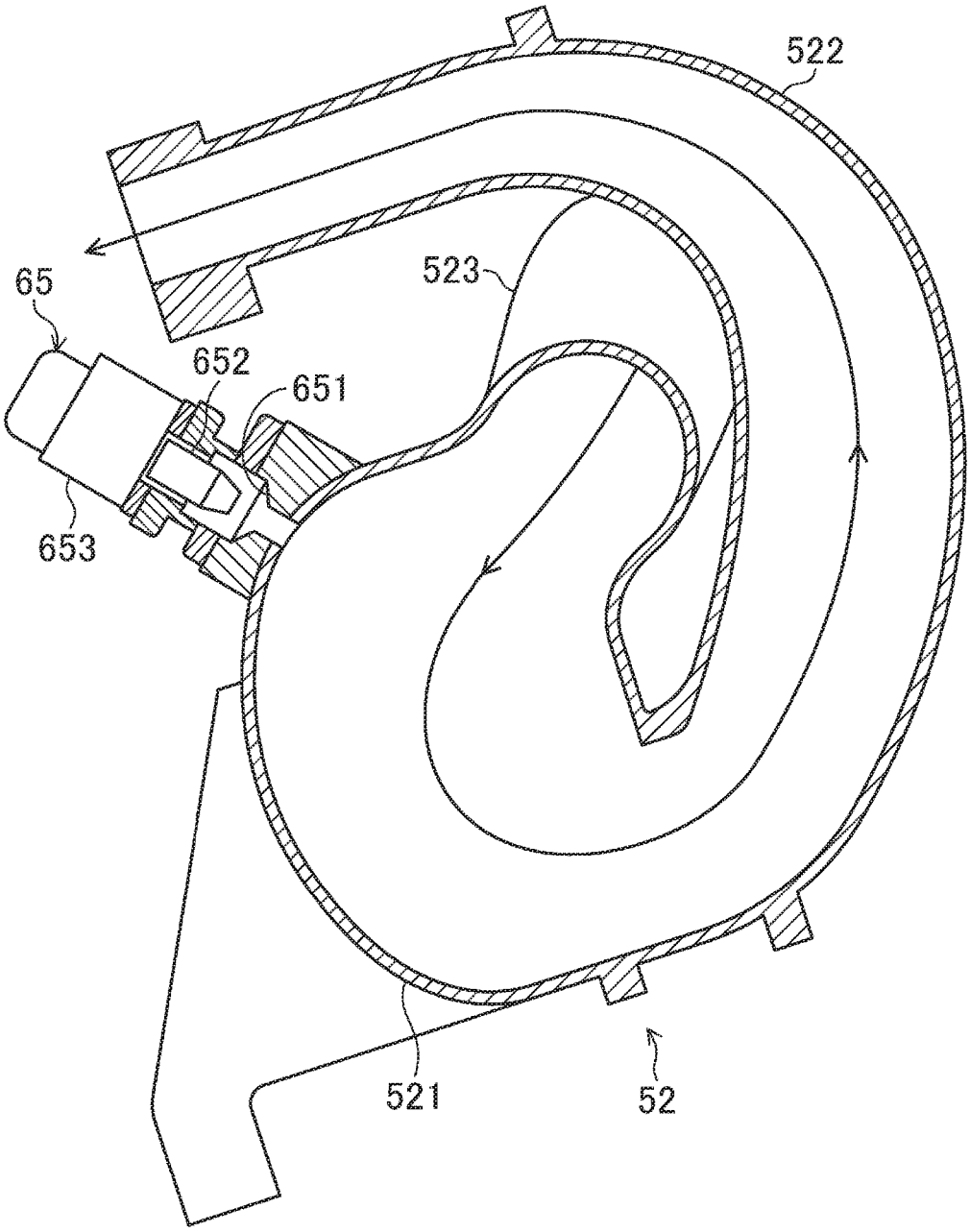
FIG. 4 is a cross-sectional view, viewed along lines IV-IV in FIG. 3.

In the intake passageway 51, a portion downstream from the throttle valve 511 is an intake manifold 52. As illustrated in FIGS. 2 to 4, the intake manifold 52 includes: a surge tank 521; independent passageways 522 each branching off, downstream of the surge tank 521, to a corresponding one of the four cylinders 24; and a common passageway 523 connected, upstream of the surge tank 521, to the intake passageway 51. The intake manifold 52 is made of multiple resin parts. The intake manifold 52 has an upper portion bolted to the cylinder head 23, and a lower portion bolted to a front side face (i.e. in the right of the view in FIG. 2, which is the front of the vehicle) of the cylinder block 22 of the engine 2. As clearly illustrated in FIGS. 2 and 4, the independent passageways 522 of the intake manifold 52 are connected to a lower portion of the surge tank 521. Each of the independent passageways 522 extends forward and upward from the lower portion of the surge tank 521, and then extends backward from the front of, and above, the surge tank 521. Thus, each of the independent passageways 522 is connected to a corresponding one of the intake ports 231 opening on a front side face of the cylinder head 23. The independent passageways 522 of the intake manifold 52 are arranged to cover the surge tank 521. As clearly illustrated in FIG. 3, the common passageway 523 of the intake manifold 52 is connected to an upper portion of the surge tank 521, and extends from the connected portion along the width of the vehicle.

An exhaust passageway 53 is connected to the exhaust port 232. In the exhaust passageway 53, a not-shown catalytic device is inserted to purify exhaust gas. In the exhaust passageway 53, a not-shown air-fuel ratio detecting sensor (i.e. an $O_2$ sensor) is also inserted for detecting an air-fuel ratio of air-fuel mixture in the combustion chamber 28. The air-fuel ratio detecting sensor outputs a detection signal to the engine controller.

As illustrated in FIG. 1, the cylinder head 23 is provided with a fuel injector 41 for each cylinder 24. The fuel injector 41 directly injects fuel (here, gasoline or fuel containing gasoline) into the cylinder 24. The fuel injector 41 may have any configuration. Examples of the configuration may be of a fuel injector having multiple orifices. In accordance with a fuel injection pulse from the engine controller, the fuel injector 41 injects, into the cylinder 24, a predetermined amount of the fuel with predetermined timing. In an example of FIG. 1, the fuel injector 41 is provided close to the exhaust-side of the cylinder 24, thereby being positioned next to a spark plug 42 to be described later. The fuel injector 41 in the cylinder 24 is not necessarily provided to the position as illustrated in the example of FIG. 1. Moreover, the fuel injector 41 may be provided to the cylinder head 23 to inject the fuel into the intake port 231.

The cylinder head 23 is also provided with a spark plug 42 for each cylinder 24. The spark plug 42 is provided so that an electrode of the spark plug 42 is placed on an axis of the cylinder 24 over a cylinder head bottom face of the cylinder head 23. The spark plug 42 generates a spark in the combustion chamber 28 to ignite the air-fuel mixture in the combustion chamber 28. In response to a spark signal from the engine controller, the spark plug 42 generates the spark with predetermined ignition timing.

As illustrated in FIG. 2, the blow-by gas recirculating apparatus 1 has an oil separator 6 (not shown in FIG. 1) provided to a front side face of the cylinder block 22 of the engine 2. The oil separator 6 includes: a body 61 provided to the front side face of the cylinder block 22 in the form of a depression; and a separator cover 62 made of resin and provided to the front side face of the cylinder block 22 to cover the body 61. A gas-liquid separation space 63 is defined between the body 61 and the separator cover 62 to separate oil mist from the blow-by gas. As illustrated by a dashed line in FIG. 2, the gas-liquid separation space 63 communicates with an interior of a crankcase 26. When the engine 2 is viewed from the side, the separator cover 62 is positioned between the intake manifold 52 and the front side face of the cylinder block 22.

Each of the body 61 and the separator cover 62 has multiple baffle plates 621. Illustrated here in FIG. 3 are the baffle plates 621 of the separator cover 62 alone. When the separator cover 62 is secured to the front side face of the cylinder block 22, the baffle plates 621 define, in the gas-liquid separation space 63, a gas passageway with a labyrinth structure. When the blow-by gas makes contact with the baffle plates 621, the oil mist included in the blow-by gas is caught on the baffle plates 621, and separated from the blow-by gas. Furthermore, the passageway conducting the blow-by gas is long because of its labyrinth structure, and the oil mist in the blow-by gas drops under its own weight. The oil mist separated in the gas-liquid separation space 63 flows downward, and returns to the crankcase 26. Note that in FIG. 3, the separator cover 62 is provided with two baffle plates 621. An appropriate number of the baffle plates are provided to the body 61 and to the separator cover 62, so that the flow resistance of the blow-by gas does not become excessively high in the gas-liquid separation space 63 of the oil separator 6.

As illustrated in FIGS. 2 and 3, the separator cover 62 has an upper end portion provided with a blow-by gas outlet port 622. The blow-by gas outlet port 622 is a connection port for taking, out of the oil separator 6, the blow-by gas passing through the gas-liquid separation space 63 of the oil separator 6.

The blow-by gas outlet port 622 has a communication part 64 connected thereto. The communication part 64 is made of a member shaped into a hose. The communication part 64 is connected through a PCV valve 65 to the surge tank 521 of the intake manifold 52.

As clearly illustrated in FIG. 2 to FIG. 4, the PCV valve 65 is provided to a PCV valve receiving portion 651 which is a space between the independent passageways 522 and the surge tank 521. The PCV valve receiving portion 651 is provided on an upper portion of the surge tank 521. The PCV valve receiving portion 651 is integrally formed with the surge tank 521 (the intake manifold 52). As illustrated by an arrow in FIG. 3, the PCV valve 65 is provided above the blow-by gas outlet port 622. Here, the term "above" means that the PCV 65 is above the blow-by gas outlet port 622 with the engine 2 mounted on the vehicle.

The PCV valve 65 is provided in a space between the independent passageways 522 and the surge tank 521, contributing to an effective use of the space. In addition, even if the vehicle collides and the impact load is applied on the front of the engine 2, the resin-made intake manifold 52 cushions the impact load. Such a feature may reduce a risk of damaging the PCV valve 65, keeping the fuel from leaking out of the crankcase 26. Moreover, the PCV valve 65 is provided away from the blow-by gas outlet port 622 along the width of the vehicle; that is, in the horizontal direction of the view in FIG. 3.

Since the PCV valve 65 and the blow-by gas outlet port 622 have such a relative positional relationship, the communication part 64, connecting both of the PCV valve 65 and the blow-by gas outlet port 622 to each other, has a vertical interval itself and a long passageway. Specifically, the communication part 64 extends at the blow-by gas outlet port 622 away from the PCV valve 65 in the vehicle width direction, horizontally turns around, and extends closer toward the PCV valve 65 in the vehicle width direction. Then, the communication part 64 is connected to the PCV valve 65. Furthermore, the PCV valve 65 is provided away from the blow-by gas outlet port 622 along the width of the vehicle. Such a feature reduces a risk of the PCV valve 65 making contact with the oil separator 6, if the intake manifold 52 is displaced and the PCV valve 65 moves backward when the vehicle collides and the impact load is applied to the front of the engine 2. This may keep the fuel from leaking out of the crankcase 26.

The PCV valve 65 is electronically controlled. As illustrated in FIG. 4, the PCV valve 65 includes a valve body 652 seated on a valve seat 651 communicating with an interior of the surge tank 521. The valve body 652 is operated by a solenoid 653. The PCV valve 65 adjusts its opening in response to the control signal from the engine controller.

Furthermore, the PCV valve 65, which is electronically controlled, is provided to the intake manifold 52. Thus, the PCV valve receiving portion 651 is moved toward the front of the vehicle on the surge tank 521, which may leave a distance between a wall surface of the engine 2 and the PCV valve 65 longer than that left when the PCV valve 65 is provided to the oil separator 6. This is beneficial in keeping an electrical control unit from thermal damage.

As described above, the PCV valve 65 is provided to the intake manifold 52. Such a feature makes it possible to use a space for providing a PCV valve, disclosed in Japanese Unexamined Patent Publication No. 2009-264275 describing the PCV valve provided to a separator cover of the oil separator, as the gas-liquid separation space 63 of the oil separator 6. Specifically, the oil separator 6 is larger in volume of the gas-liquid separation space 63 than the oil separator disclosed in Japanese Unexamined Patent Publication No. 2009-264275 for the space in which the PCV valve is provided if the separators are the same in size. Such a feature may enhance the gas-liquid separation capability of the oil separator 6. Specifically, the PCV valve 65, which is electronically controlled, is larger than a mechanical PCV valve with an increase in a size of a valve body driving mechanism. Providing the electronically controlled PCV valve 65 to the separator cover 62 significantly reduces the gas-liquid separation space 63 of the oil separator 6. In this point, too, providing the electronically controlled PCV valve 65 to the intake manifold 52 is beneficial in keeping the gas-liquid separation space 63 large.

Moreover, the PCV valve 65 is positioned above the blow-by gas outlet port 622 of the oil separator 6, so that the interior of the communication part 64, connecting the PCV valve 65 and the blow-by gas outlet port 622 to each other, may act as a gas-liquid separation space. Such a feature may also increase the volume of the gas-liquid separation space 63 of the oil separator 6, contributing to enhancing the gas-liquid separation capability of the oil separator 6.

As described before, this engine 2 is set to have a high geometrical compression ratio. Hence, this engine 2 tends to have an increasing amount of blow-by gas entering the crankcase 26 from the combustion chamber 28. However, the high gas-liquid separation capability of the oil separator 6 enables increasing the amount of recirculating blow-by gas and sufficiently ventilating the crankcase 26. Here, for example, when the engine 2 is running under a condition in which the fuel is difficult to be vaporized and tends to be caught on a wall of a combustion chamber, such as warm-up operation, the crankcase 26 needs more ventilation in this condition than in normal operation because a fuel component concentration of the blow-by gas in the crankcase 26 becomes high, regardless of a pressure difference between a negative pressure in the intake passageway 51 and a pressure in the crankcase 26. In this case, the electronically controlled PCV valve 65, which is different from a mechanical PCV valve whose opening is set based on the pressure difference between a negative pressure in the intake passageway 51 and a pressure in the crankcase 26, may set the opening greater in order to sufficiently ventilate the crankcase 26 based on an estimate of the fuel component concentration in the blow-by gas. For example, the fuel component concentration of the blow-by gas is estimated based on an engine temperature, a cooling water temperature, an engine revolution, an engine load, and a fuel injection amount. In combination with a high gas-liquid separation capability of the oil separator 6, the sufficient ventilation of the crankcase 26 may reduce deterioration of oil stored in the oil pan 29.

Here, the oil separator 6 could be provided to, for example, a head cover of the cylinder head 23, other than to the side face of the cylinder block 22 of the engine 2. As described before, however, if the intake valve train 32 and the exhaust valve train 34 of the engine 2 are implemented as a variable valve timing mechanism capable of varying a lift amount and an opening period of a valve for each cylinder, the intake valve train 32 and the exhaust valve train 34, both of which are large in size, are inevitably arranged over the cylinder head 23. Such an arrangement makes it practically impossible to leave a gas-liquid separation space having a sufficiently large volume to the head cover of the cylinder head 23. Securing the oil separator 6 to the head cover of the cylinder head 23 allows the largest possible gas-liquid separation space to be left to the oil separator 6 provided to the side face of the engine 2.

The PCV valve 65 is provided to the upper portion of the surge tank 521. As described before, the surge tank 521 has the upper portion connected to the common passageway 523 and the lower portion connected to the surge tank 521. In the surge tank 521, intake air flows from the upper portion toward the lower portion, as indicated with an arrow in FIG. 4. Since provided to the upper portion of the surge tank 521, the PCV valve 65 is positioned upstream of the airflow in the surge tank 521. The blow-by gas introduced into the surge tank 521 is sufficiently mixed with the intake air (i.e. fresh air). Such sufficient mixing contributes to uniformity in concentration of the blow-by gas to be distributed to, and introduced into, each of the cylinders 24 through the independent passageways 522. Furthermore, in order to introduce the blow-by gas upstream of the airflow in the surge tank 521, the PCV valve 65 may be provided close to the common passageway 523, with respect to the surge tank 521, along the width of the vehicle.

Moreover, providing the PCV valve 65 directly to the intake manifold 52 improves responsiveness, in the introduction of the blow-by gas into the intake manifold 52, to a change in the opening of the PCV valve 65. In addition, the PCV valve 65 is electronically controlled, improving the responsiveness, in the introduction of the blow-by gas into the intake manifold 52, to the control signal to be output by the engine controller. Such features make it possible to control an air-fuel ratio of the engine 2 with high responsiveness and accuracy.

Furthermore, as illustrated in FIG. 2, the PCV valve 65 is placed between the engine 2 and the intake manifold 52 secured to a front side portion of the engine 2. Specifically, in the front of the transversely mounted engine 2, (i.e. in the right of the view in FIG. 2, which is the front of the vehicle) the PCV valve 65 is positioned in the back (i.e. to the left of the view in FIG. 2, which is the rear of the vehicle) of the intake manifold 52. Such positioning of the PCV valve 65 allows the impact load to be applied to the intake manifold 52 before applied to the PCV valve 65 when the vehicle collides. The intake manifold 52 made of resin may absorb the impact load, contributing to reducing a risk of damaging the PCV valve 65. Such a feature may keep the blow-by gas from leaking to the air when the vehicle collides.

Note that the PCV valve 65 in the above configuration is provided to the surge tank 521 of the intake manifold 52. Instead, the PCV valve 65 may be provided to the common passageway 523.

Moreover, the PCV valve 65 is not limited to an electronically controlled one. Instead, the PCV valve 65 may be a mechanical one.

What is claimed is:

1. A blow-by gas recirculating apparatus comprising:

an intake manifold secured to one side of an engine, and configured to introduce intake air into a combustion chamber, the intake manifold includes independent passageways each branching off downstream of the surge tank, and a common passageway connected upstream of the surge tank;

the independent passageways are connected to a lower portion of the surge tank;

the common passageway is connected to an upper portion of the surge tank;

an oil separator provided to a side surface of a cylinder block at the one side of the engine, and configured to separate oil mist from blow-by gas;

a conduit configured to provide communication between a blow-by gas outlet port of the oil separator and the intake manifold; and a PCV valve configured to adjust a flow amount of the blow-by gas to be introduced into the intake manifold via the conduit, the PCV valve physically contacting an upper portion of the surge tank, and communicating with an interior of the surge tank, the conduit being connected to the PCV valve, and the PCV valve provided to the intake manifold being positioned above the blow-by gas outlet port of the oil separator with the engine mounted on a vehicle.

2. The blow-by gas recirculating apparatus of claim 1, wherein the PCV valve is configured to introduce the blow-by gas into an upstream portion of an airflow in the surge tank.

3. The blow-by gas recirculating apparatus of claim 1, wherein the PCV valve is electronically controlled, and has an opening adjusted with a control signal.

4. The blow-by gas recirculating apparatus of claim 3, wherein based on an estimate of a fuel component concentration in the blow-by gas, the PCV valve, electronically controlled, is configured to set the opening greater as the estimate of the fuel component concentration is higher.

5. The blow-by gas recirculating apparatus of claim 2, wherein the PCV valve is electronically controlled, and has an opening adjusted with a control signal.

6. The blow-by gas recirculating apparatus of claim 5, wherein based on an estimate of a fuel component concentration in the blow-by gas, the PCV valve, electronically controlled, is configured to set the opening greater as the estimate of the fuel component concentration is higher.

7. The blow-by gas recirculating apparatus of claim 1, wherein the PCV valve is placed between the engine and the intake manifold secured to a side portion of the engine.

8. The blow-by gas recirculating apparatus of claim 2, wherein the PCV valve is placed between the engine and the intake manifold secured to a side portion of the engine.

9. The blow-by gas recirculating apparatus of claim 3, wherein the PCV valve is placed between the engine and the intake manifold secured to a side portion of the engine.

10. The blow-by gas recirculating apparatus of claim 4, wherein the PCV valve is placed between the engine and the intake manifold secured to a side portion of the engine.

11. The blow-by gas recirculating apparatus of claim 5, wherein the PCV valve is placed between the engine and the intake manifold secured to a side portion of the engine.

12. The blow-by gas recirculating apparatus of claim 6, wherein the PCV valve is placed between the engine and the intake manifold secured to a side portion of the engine.

13. A blow-by gas recirculating apparatus comprising:

an intake manifold secured to one side of an engine, and configured to introduce intake air into a combustion chamber, the intake manifold includes independent passageways each branching off downstream of the surge tank, and a common passageway connected upstream of the surge tank;

the independent passageways are connected to a lower portion of the surge tank;

the common passageway is connected to an upper portion of the surge tank;

an oil separator provided to a side surface of a cylinder block at the one side of the engine, and configured to separate oil mist from blow-by gas;

a conduit configured to provide communication between a blow-by gas outlet port of the oil separator and the intake manifold; and a PCV valve configured to adjust a flow amount of the blow-by gas to be introduced into the intake manifold via the conduit, the PCV valve being provided on a PCV valve receiving portion, which is provided on an upper portion of the surge tank of the intake manifold, and communicating with an interior of the surge tank, the conduit being connected to the PCV valve, and the PCV valve provided to the intake manifold being positioned above the blow-by gas outlet port of the oil separator with the engine mounted on a vehicle.

14. A blow-by gas recirculating apparatus comprising:

an intake manifold secured to one side of an engine, and configured to introduce intake air into a combustion chamber, the intake manifold includes independent passageways each branching off, downstream of the surge tank and a common passageway connected upstream of the surge tank;

the independent passageways are connected to a lower portion of the surge tank;

the common passageway is connected to an upper portion of the surge tank;

an oil separator provided to a side surface of a cylinder block at the one side of the engine, and configured to separate oil mist from a blow-by gas;

a conduit configured to provide communication between a blow-by gas outlet port of the oil separator and the intake manifold; and a PCV valve configured to adjust a flow amount of the blow-by gas to be introduced into the intake manifold via the conduit, the conduit extends at the blow-by gas outlet port away from the PCV valve in the vehicle width direction, horizontally turns around, and extends closer toward the PCV valve in the vehicle width direction, the PCV valve being provided on a PCV valve receiving portion, which is provided on an upper portion of the surge tank of the intake manifold, and communicating with an interior of said surge tank, and the PCV valve provided to the intake manifold being positioned above the blow-by gas outlet port of the oil separator with the engine mounted on a vehicle.

* * * * *